US009772590B2

(12) United States Patent
Kim et al.

(10) Patent No.: US 9,772,590 B2
(45) Date of Patent: Sep. 26, 2017

(54) BELT TYPE FIXING APPARATUS AND IMAGE FORMING APPARATUS COMPRISING SAME

(71) Applicant: SAMSUNG ELECTRONICS CO., LTD., Suwon-si, Gyeonggi-do (KR)

(72) Inventors: Jun-tae Kim, Suwon-si (KR); Seung-jun Lee, Suwon-si (KR); Dong-woo Lee, Seoul (KR); Dong-jin Seol, Suwon-si (KR); Soo-hwan Bae, Yongin-si (KR); Bong-hee Lee, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/109,749

(22) PCT Filed: Dec. 23, 2014

(86) PCT No.: PCT/KR2014/012689
§ 371 (c)(1),
(2) Date: Jul. 5, 2016

(87) PCT Pub. No.: WO2015/102285
PCT Pub. Date: Jul. 9, 2015

(65) Prior Publication Data

US 2016/0327893 A1 Nov. 10, 2016

(30) Foreign Application Priority Data

Jan. 6, 2014 (KR) ..... 10-2014-0001108
Jun. 20, 2014 (KR) ..... 10-2014-0075660

(51) Int. Cl.
*G03G 15/20* (2006.01)

(52) U.S. Cl.
CPC ..... *G03G 15/2085* (2013.01); *G03G 15/2053* (2013.01); *G03G 2215/2025* (2013.01)

(58) Field of Classification Search
CPC ..... G03G 15/2053; G03G 15/2032
See application file for complete search history.

(56) References Cited

U.S. PATENT DOCUMENTS 5,149,941 A 9/1992 Hirabayashi et al.
5,210,579 A 5/1993 Setoriyama et al.
(Continued)

FOREIGN PATENT DOCUMENTS

JP 2000-199550 7/2000
JP 2001-134120 5/2001
(Continued)

OTHER PUBLICATIONS

International Search Report dated Mar. 27, 2015, in corresponding International Application No. PCT/KR2014/012689.
(Continued)

*Primary Examiner* — Clayton E Laballe
*Assistant Examiner* — Noam Reisner
(74) *Attorney, Agent, or Firm* — Staas & Halsey LLP

(57) ABSTRACT

A belt type fixing apparatus comprises: a fixing roller; a fixing belt which is installed to be opposite to the fixing roller;
a nip forming member which is installed inside the fixing belt and supports the fixing belt so that the fixing belt can contact the fixing roller to form a fixing nip; a pair of sliding members which are installed to support both ends of the fixing belt and are rotated by the fixing belt; a pair of flange members which rotatably support the pair of sliding members; and a heat source which is installed inside the fixing belt and generates heat, wherein the rotation center of the
(Continued)

pair of sliding members is located upstream in the transportation direction of printed matter compared to the rotation center of the fixing roller.

15 Claims, 11 Drawing Sheets

(56) References Cited

U.S. PATENT DOCUMENTS

| | | | |
|---|---|---|---|
| 5,235,395 | A | 8/1993 | Ishiwata |
| 5,257,078 | A | 10/1993 | Kuroda |
| 5,525,775 | A | 6/1996 | Setoriyama et al. |
| 6,748,192 | B2 | 6/2004 | Izawa et al. |
| 6,794,611 | B2 | 9/2004 | Kataoka et al. |
| 6,937,837 | B2 | 8/2005 | Takeuchi et al. |
| 7,283,780 | B2 | 10/2007 | Uchida et al. |
| 7,469,120 | B2 | 12/2008 | Iwasaki et al. |
| 7,769,332 | B2 | 8/2010 | Yamamoto et al. |
| 7,865,120 | B2 | 1/2011 | Suzuki et al. |
| 8,068,778 | B2 | 11/2011 | Kaino et al. |
| 8,131,197 | B2 | 3/2012 | Hiraoka et al. |
| 8,369,765 | B2 | 2/2013 | Arimoto |
| 8,410,676 | B2 | 4/2013 | Feng et al. |
| 8,428,498 | B2 | 4/2013 | Fujiwara et al. |
| 8,478,180 | B2 | 7/2013 | Arimoto et al. |
| 2002/0110394 | A1 | 8/2002 | Takeuchi et al. |
| 2002/0146259 | A1 | 10/2002 | Zhou et al. |
| 2005/0180788 | A1* | 8/2005 | Watanabe ..... G03G 15/2064 399/328 |
| 2005/0185994 | A1* | 8/2005 | Inada ..... G03G 15/2053 399/328 |
| 2006/0054467 | A1 | 3/2006 | Oishi |
| 2008/0232870 | A1 | 9/2008 | Ardery et al. |
| 2008/0240807 | A1 | 10/2008 | Lee et al. |
| 2012/0027478 | A1* | 2/2012 | Tsukioka ..... G03G 15/2053 399/329 |
| 2012/0148303 | A1 | 6/2012 | Yamaguchi et al. |
| 2013/0177340 | A1 | 7/2013 | Kawata et al. |
| 2014/0056626 | A1* | 2/2014 | Sakai ..... G03G 15/2017 399/329 |

FOREIGN PATENT DOCUMENTS

| | | |
|---|---|---|
| JP | 2002-72723 | 3/2002 |
| JP | 2002-231419 | 8/2002 |
| JP | 2003-255642 | 9/2003 |
| JP | 2004-163464 | 6/2004 |
| JP | 2012-155350 | 8/2012 |
| JP | 2012-203380 | 10/2012 |
| KR | 10-2002-0064194 | 8/2002 |
| KR | 10-2008-0088060 | 10/2008 |

OTHER PUBLICATIONS

Extended European Search Report dated Jul. 13, 2017 in European Patent Application No. 14876637.1.

* cited by examiner

[Fig. 1]
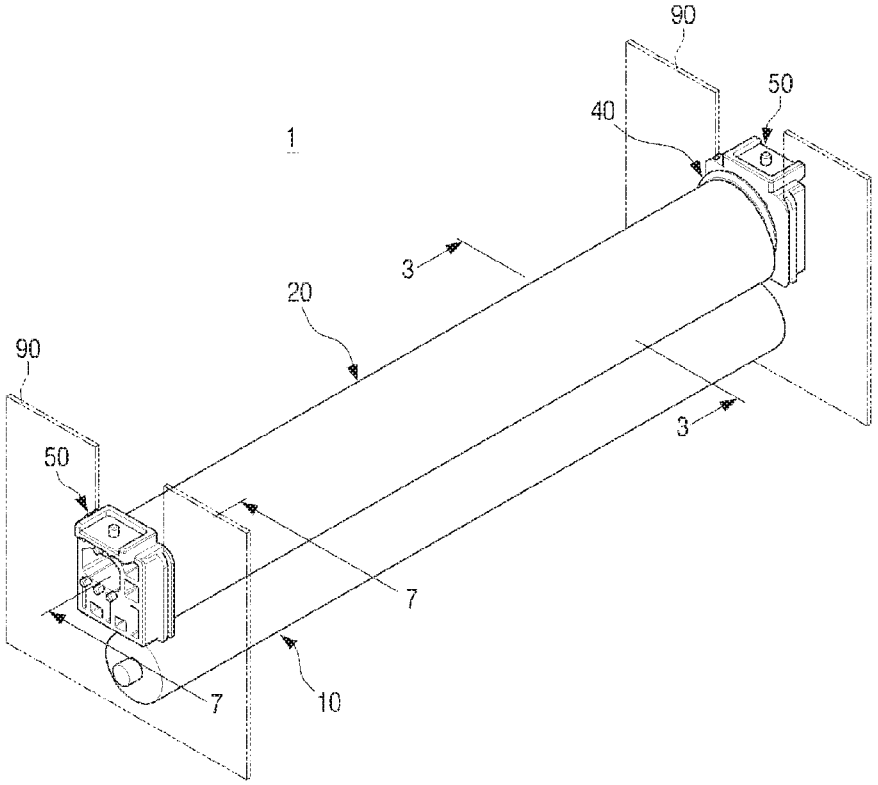

[Fig. 2]
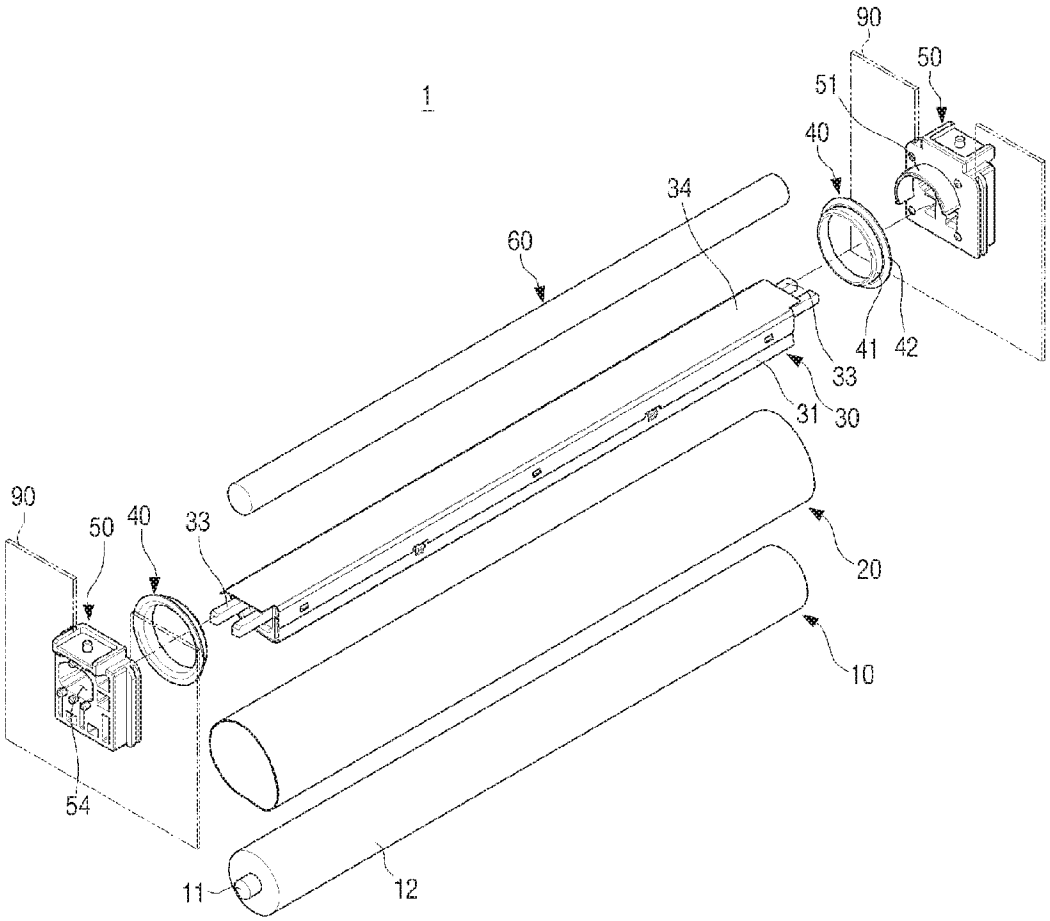

[Fig. 3]
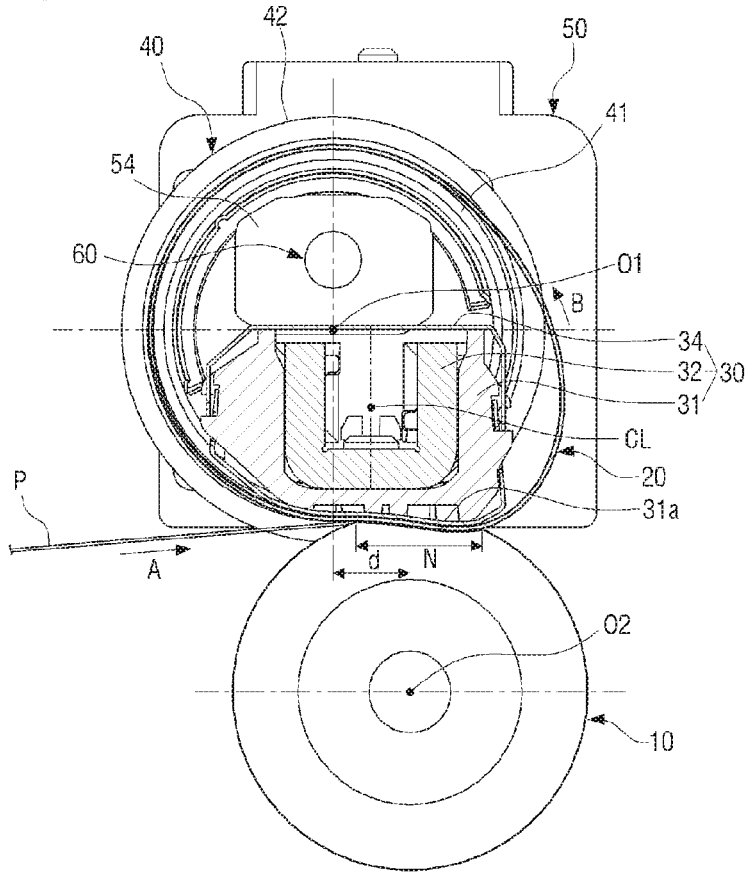
[Fig. 4]
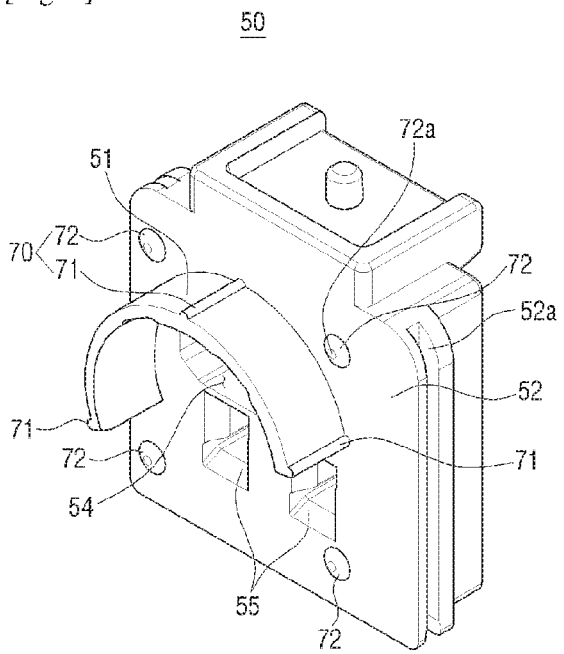

[Fig. 5]
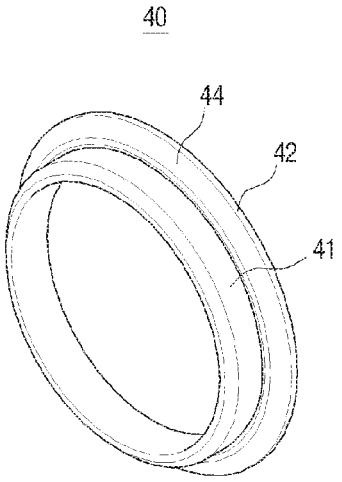
[Fig. 6]
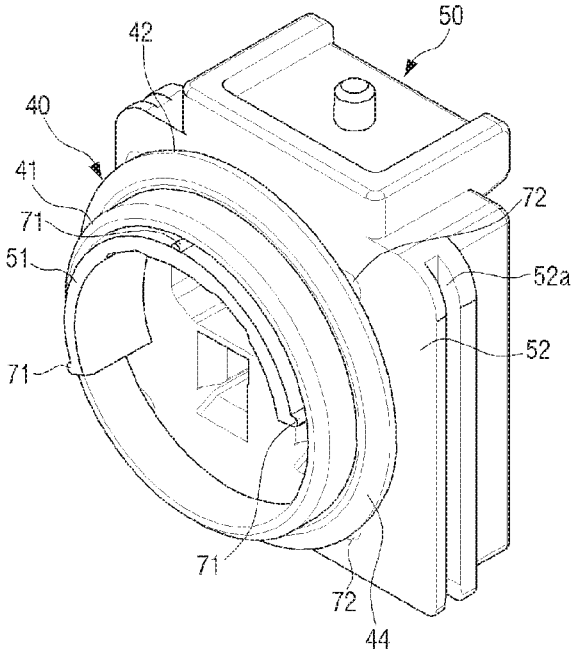

[Fig. 7]
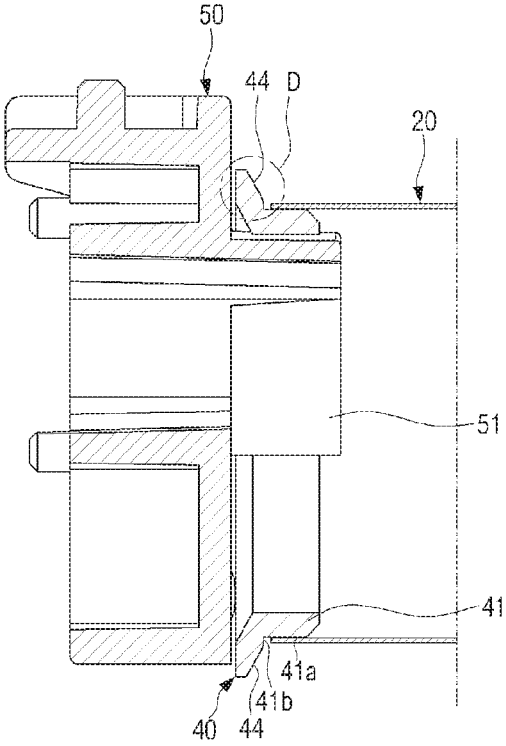
[Fig. 8]
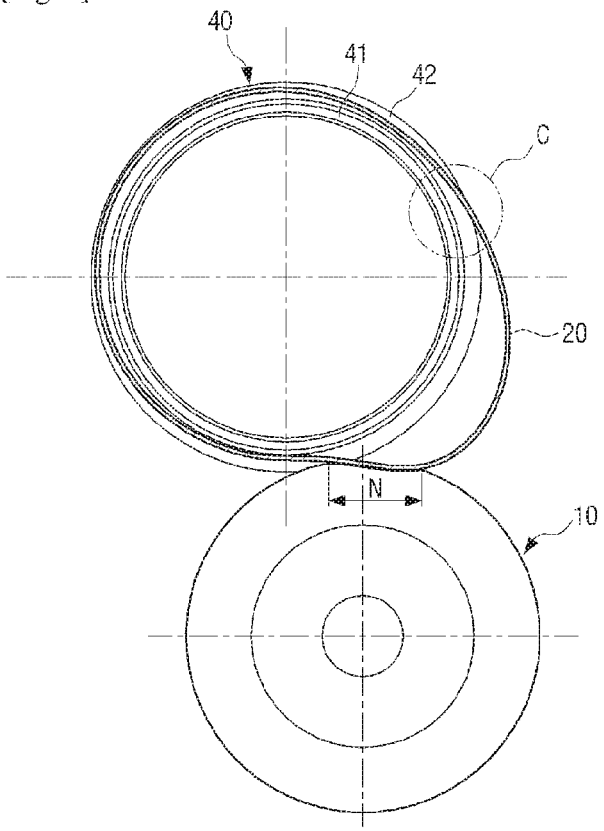

[Fig. 9A]
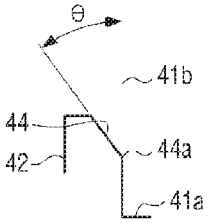
[Fig. 9B]
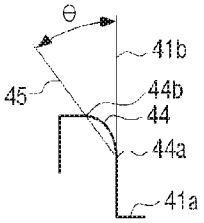
[Fig. 9C]
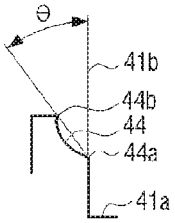
[Fig. 10]
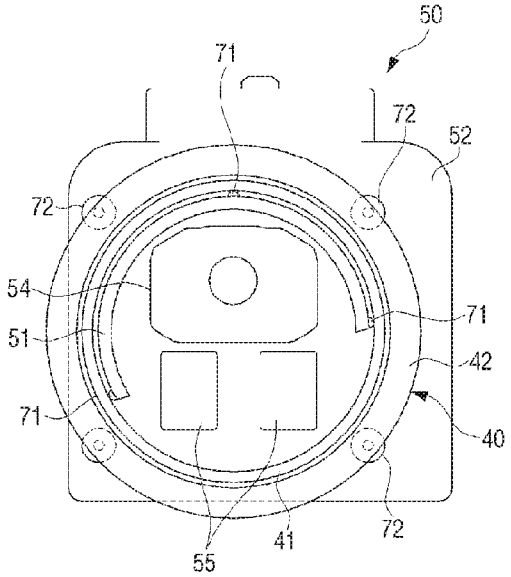
[Fig. 11]
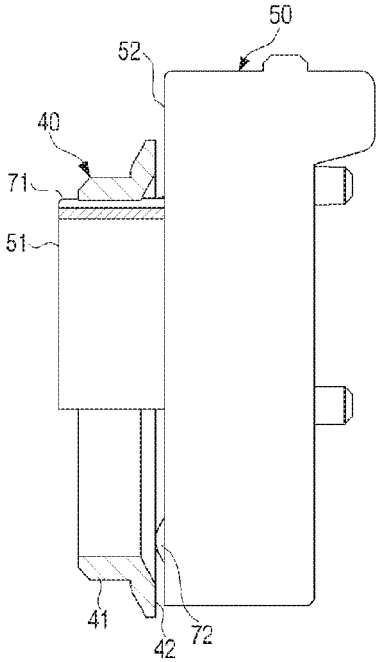

[Fig. 12]
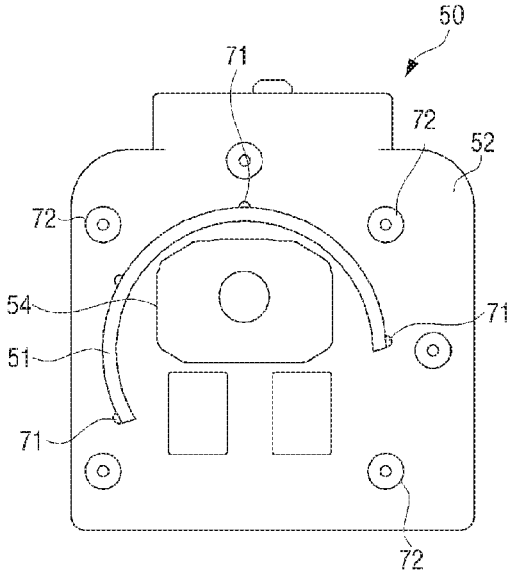
[Fig. 13A]
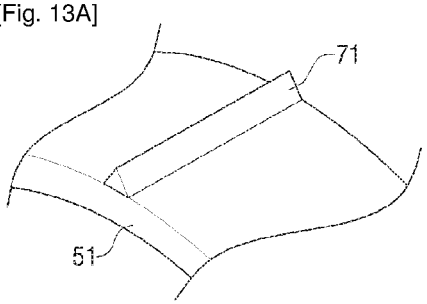
[Fig. 13B]
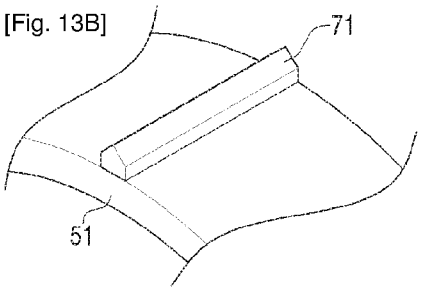

[Fig. 14]
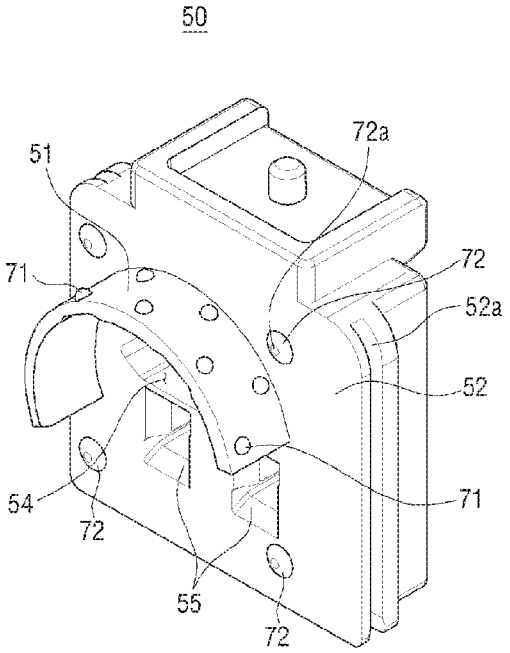
[Fig. 15]
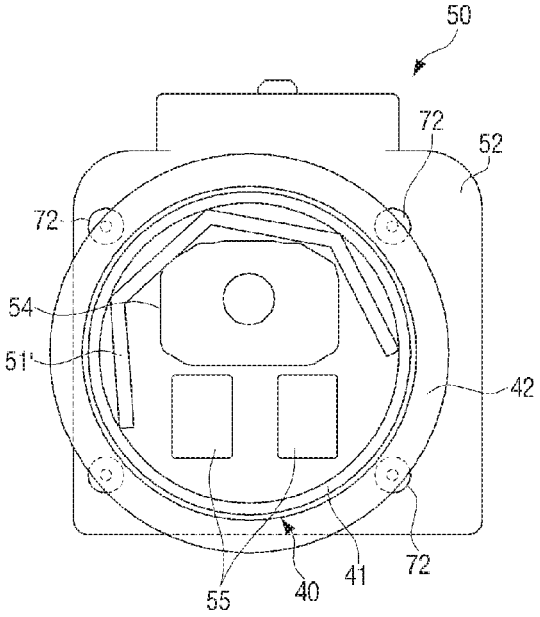

[Fig. 16]
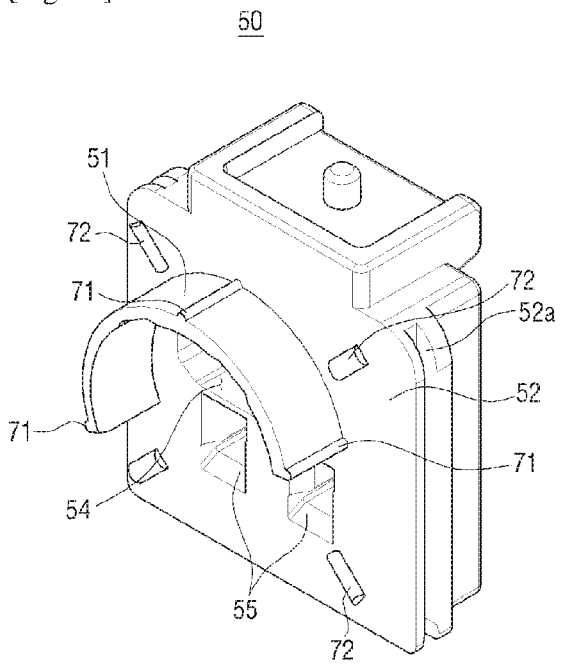
[Fig. 17]
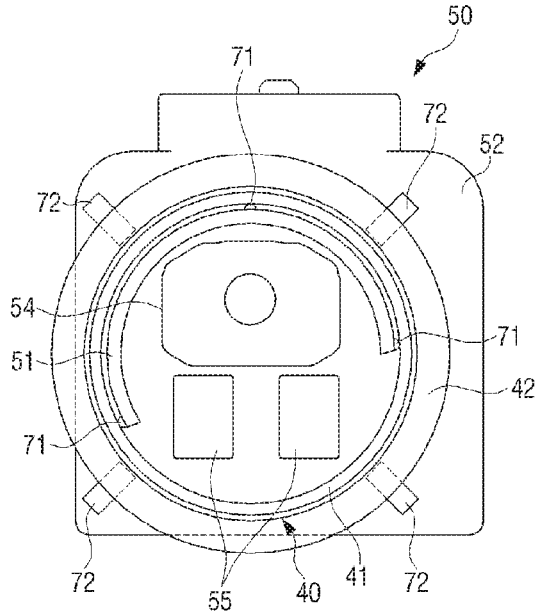

[Fig. 18]
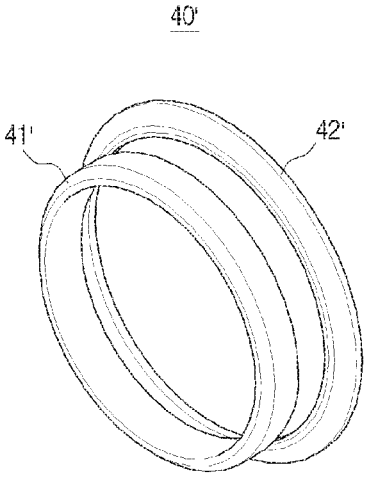
[Fig. 19]
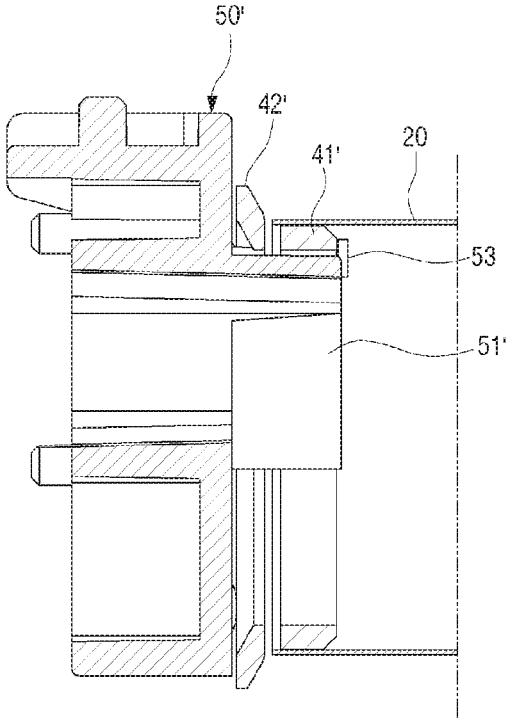

[Fig. 20]
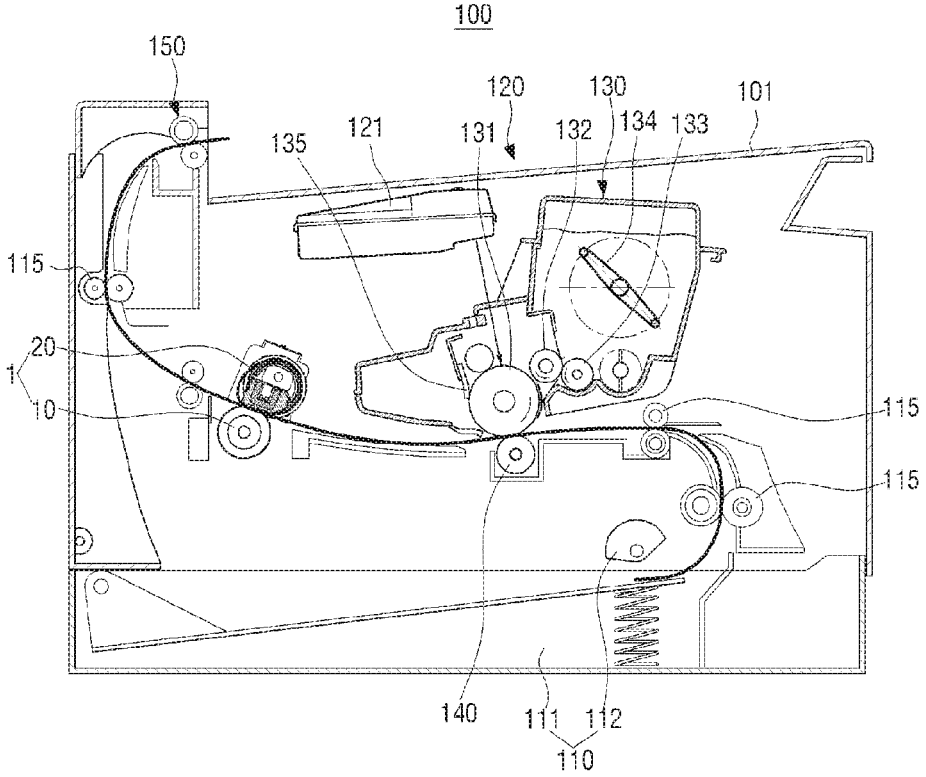

BELT TYPE FIXING APPARATUS AND IMAGE FORMING APPARATUS COMPRISING SAME

CROSS-REFERENCE TO RELATED APPLICATIONS

This application is a U.S. National Stage Application, which claims the benefit under 35 U.S.C. §371 of PCT International Patent Application No. PCT/KR2014/012689, filed Dec. 23, 2014, which claims the foreign priority benefit under 35 U.S.C. §119 of Korean Patent Application No. 10-2014-0001108, filed Jan. 6, 2014, and Korean Patent Application No. 10-2014-0075660, filed Jun. 20, 2014, the contents of which are incorporated herein by reference.

1. TECHNICAL FIELD

The present disclosure relates to an image forming apparatus. More particularly, the present disclosure relates to a fixing apparatus configured to fix an image onto a print medium.

2. BACKGROUND ART

Generally, an electro-photographic image forming apparatus such as a laser printer forms a developer image corresponding to a certain image on a print medium, and uses a fixing apparatus that permanently fixes the developer image onto the print medium by applying heat and pressure to the developer image.

The fixing apparatus includes a pair of rollers, namely, a heat roller configured to generate heat to be applied to the print medium and a fixing roller configured to apply a predetermined pressure to the print medium.

However, these days, image forming apparatuses for high-speed printing have widely used a fixing apparatus configured to use a fixing belt of an endless belt instead of a heat roller.

However, since fatigue cracks occur at opposite ends of the fixing belt due to repetitive rotation of the fixing belt, there is a problem that the fixing apparatus using the fixing belt has a short life-span.

Accordingly, a fixing apparatus that can increase a service life by suppressing the fatigue crack at opposite ends of a fixing belt is required to be developed.

SUMMARY

The present disclosure has been developed in order to overcome the above drawbacks and other problems associated with the conventional arrangement. An aspect of the present disclosure is to provide a belt type fixing apparatus that can increase a life-span by minimizing fatigue crack at opposite ends of a fixing belt.

The above aspect and/or other feature of the present disclosure can substantially be achieved by providing a belt type fixing apparatus, which may include a fixing roller; a fixing belt disposed to face the fixing roller; a nip forming member disposed inside the fixing belt, the nip forming member supporting the fixing belt so that the fixing belt is in contact with the fixing roller to form a fixing nip; a pair of sliding members disposed to support inner surfaces of opposite ends of the fixing belt, the pair of sliding members configured to rotate with the fixing belt inside the fixing belt while supporting the inner surfaces of the fixing belt; and a pair of flange members configured to rotatably support the pair of sliding members.

When the fixing belt is rotated by the fixing roller, a first speed of the sliding member which rotates against the flange member may be larger than a second speed of the fixing belt which rotates against the sliding member.

The fixing belt may rotate integrally with the sliding members.

The sliding member may include an inner surface supporting portion supporting the inner surface of each of the opposite ends of the fixing belt; and a flange formed in a direction perpendicular to the inner surface supporting portion, the flange configured to restrict movement of the fixing belt in a central axis direction of the fixing belt.

The inner surface supporting portion and the flange of the sliding member may be formed as separate parts.

The inner surface supporting portion and the flange of the sliding member may be formed as a single body.

The flange of the sliding member may include an entry surface that is inclined to a surface perpendicular to the inner surface supporting portion.

The entry surface may include a plane that is inclined an angle between 15 degrees and 75 degrees with respect to the surface perpendicular to the inner surface supporting portion of the sliding member.

The entry surface may be formed as a curved surface, and a straight line connecting a start point and an end point of the curved surface may form an angle between 15 degrees and 75 degrees with respect to the surface perpendicular to the inner surface supporting portion of the sliding member.

The entry surface may include a convex curved surface.

The entry surface may include a concave curved surface.

The belt type fixing apparatus may include a heat source disposed inside the fixing belt and configured to generate heat.

A rotation center of each of the pair of sliding members may be located upstream in a moving direction of a print medium than a rotation center of the fixing roller.

A rotation center of each of the pair of sliding members may be located upstream in a moving direction of a print medium than a center line of the nip forming member.

The flange member may include a stationary body; and a sliding support portion extending from the stationary body and configured to rotatably support the sliding member.

The flange member may include a friction reducing portion that can reduce friction against the sliding member.

The friction reducing portion may include at least three first projections that are formed on a surface of the sliding support portion facing an inner surface of the sliding member.

The friction reducing portion may include at least three second projections that are formed on a surface of the stationary body facing a side surface of the sliding member.

The friction reducing portion may include at least three first projections that are formed on an outer surface of the sliding support portion facing an inner surface of the sliding member and at least three second projections that are formed on a surface of the stationary body facing a side surface of the sliding member.

According to another aspect of the present disclosure, a belt type fixing apparatus may include a fixing roller; a fixing belt disposed to face the fixing roller; a nip forming member disposed inside the fixing belt, the nip forming member supporting the fixing belt so that the fixing belt is in contact with the fixing roller to form a fixing nip; a pair of sliding members disposed to support inner surfaces of opposite ends of the fixing belt, the pair of sliding members configured to rotate with the fixing belt inside the fixing belt while supporting the inner surfaces of the fixing belt; and a pair of flange members configured to rotatably support the pair of sliding members, wherein the each of the pair of flange members may include a friction reducing portion capable of reducing friction against each of the pair of sliding members.

The friction reducing portion may be formed to be in line contact or point contact with the sliding member.

The friction reducing portion may include at least three first projections that are formed on a surface of the sliding support portion of the flange member facing an inner surface of the sliding member.

The friction reducing portion may include at least three second projections that are formed on one surface of the flange member facing a side surface of the sliding member.

The friction reducing portion may include at least three first projections that are formed on a surface of the sliding support portion of the flange member facing an inner surface of the sliding member and at least three second projections that are formed on one surface of the flange member facing a side surface of the sliding member.

According to another aspect of the present disclosure, an image forming apparatus may include an image forming unit configured to form an image on a print medium; and a belt type fixing apparatus configured to fix the image formed on the print medium in the image forming unit, the belt type fixing apparatus including at least one among the above-described features.

Other objects, advantages and salient features of the present disclosure will become apparent from the following detailed description, which, taken in conjunction with the annexed drawings, discloses preferred embodiments.

BRIEF DESCRIPTION OF THE DRAWINGS

These and/or other aspects and advantages of the present disclosure will become apparent and more readily appreciated from the following description of the embodiments, taken in conjunction with the accompanying drawings of which:

FIG. 1 is a perspective view schematically illustrating a belt type fixing apparatus according to an embodiment of the present disclosure;

FIG. 2 is an exploded perspective view illustrating the belt type fixing apparatus of FIG. 1;

FIG. 3 is a cross-sectional view illustrating the belt type fixing apparatus of FIG. 1 taken along a line 3-3;

FIG. 4 is a perspective view illustrating a flange member of the belt type fixing apparatus of FIG. 1;

FIG. 5 is a perspective view illustrating a sliding member of the belt type fixing apparatus of FIG. 1;

FIG. 6 is a perspective view illustrating a flange member in which a sliding member of the belt type fixing apparatus of FIG. 1 is disposed;

FIG. 7 is a partial cross-sectional view illustrating the belt type fixing apparatus of FIG. 1 taken along a line 7-7;

FIG. 8 is a view illustrating a relationship between a fixing belt and a sliding member when skew of a fixing belt occurs in a belt type fixing apparatus according to an embodiment of the present disclosure;

FIGS. 9A, 9B and 9C are cross-sectional views illustrating shapes of an entry portion of a sliding member which is used in a belt type fixing apparatus according to an embodiment of the present disclosure;

FIG. 10 is a front view illustrating a flange member in which the sliding member of FIG. 6 is disposed;

FIG. 11 is a side view illustrating a flange member in which the sliding member of FIG. 6 is disposed;

FIG. 12 is a front view illustrating a flange member provided with a friction reducing portion according to another example;

FIG. 13A is a partial perspective view illustrating a case in which a first projection of a friction reducing portion of a flange member is a triangular pillar shape;

FIG. 13B is a partial perspective view illustrating a case in which a first projection of a friction reducing portion of a flange member is a pentagonal pillar shape;

FIG. 14 is a perspective view illustrating a flange member provided with first projections of a friction reducing portion that are a spherical surface;

FIG. 15 is a front view illustrating a state in which a flange member provided with a friction reducing portion according to another example supports a sliding member;

FIG. 16 is a perspective view illustrating a flange member provided with a friction reducing portion according to another example;

FIG. 17 is a front view illustrating the flange member of FIG. 16 in which a sliding member is disposed;

FIG. 18 is a perspective view illustrating another example of a sliding member which is used in a belt type fixing apparatus according to an embodiment of the present disclosure;

FIG. 19 is a partial cross-sectional view illustrating a relationship between a flange member, a sliding member, and a fixing belt when a split type sliding member as illustrated in FIG. 18 is used; and FIG. 20 is a cross-sectional view schematically illustrating an image forming apparatus including a belt type fixing apparatus according to an embodiment of the present disclosure.

Throughout the drawings, like reference numerals will be understood to refer to like parts, components and structures.

DETAILED DESCRIPTION OF THE EXEMPLARY EMBODIMENTS

Hereinafter, certain exemplary embodiments of the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

FIG. 1 is a perspective view schematically illustrating a belt type fixing apparatus 1 according to an embodiment of the present disclosure, and FIG. 2 is an exploded perspective view illustrating the belt type fixing apparatus 1 of FIG. 1. FIG. 3 is a cross-sectional view illustrating the belt type fixing apparatus 1 of FIG. 1 taken along a line 3-3.

Referring to FIGS. 1 through 3, the belt type fixing apparatus 1 according to an embodiment of the present disclosure includes a fixing roller 10, a fixing belt 20, a nip forming member 30, a pair of sliding members 40, a pair of flange members 50, and a heat source 60.

The fixing roller 10 applies a predetermined pressure to a print medium P, and is formed in a roller shape. The fixing roller 10 includes a shaft 11 formed of a metal material, such as aluminum, steel, etc., and an elastic layer 13 to be elastically deformed to form a fixing nip N between the fixing belt 20 and the fixing roller 10. The elastic layer 13 may be formed of a silicon rubber. Although not illustrated in FIGS. 1 through 3, the fixing roller 10 may be configured to rotate by receiving power from a driving source such as a motor. The structure in which the fixing roller 10 is rotated by the driving source is the same as or similar to the driving structures of conventional fixing rollers. Therefore, a detailed description thereof is omitted.

The fixing belt 20 is to apply a predetermined heat to a print medium P. In the same way as a conventional heat roller, the fixing belt 20 is heated by the heat source 60 and transfers heat to a print medium P passing through the fixing nip N. Accordingly, the fixing belt 20 is disposed to face the fixing roller 10, and forms a fixing nip N through which the print medium P passes with the fixing roller 10. If the fixing roller 10 rotates, the fixing belt 20 is rotated by a friction force between the fixing belt 20 and the fixing roller 10. The fixing belt 20 is formed to have an axial length longer than an axial length of the fixing roller 10. The fixing belt 20 may be formed in a single layer of metal, heat resistant polymer, etc., or multi-layers including a base layer formed of metal or heat resistant polymer, an elastic layer, and a protection layer. The fixing belt 20 may be the same as or similar to the fixing belts used in conventional belt type fixing apparatuses. Therefore, a detailed description of the fixing belt 20 is omitted.

The nip forming member 30 is disposed inside the fixing belt 20, and supports an inner surface of the fixing belt 20 so that the fixing belt 20 is in contact with the fixing roller 10 to form the fixing nip N. The nip forming member 30 has a length longer than the length of the fixing roller 10. Accordingly, when the fixing roller 10 is in contact with the fixing belt 20 to form the fixing nip N, bending at the opposite ends of the fixing belt 20 by the fixing roller 10 is not generated. In detail, the nip forming member 30 includes a guide member 31, which is in contact with the inner surface of the fixing belt 20 and guides the fixing belt 20, and a supporting member 32 which is disposed above the guide member 31, and presses and supports the guide member 31.

The guide member 31 forms the fixing nip N by contacting the inner surface of the fixing belt 20, and guides the fixing belt 20 so that the fixing belt 20 can smoothly move in the fixing nip N. The guide member 31 is formed in a channel shape of which a cross-section is substantially U-shape with a flat bottom. The supporting member 32 is disposed inside the guide member 31. A heat blocking member 34 is disposed above the guide member 31, and both side ends of the heat blocking member 34 are secured to the opposite side surfaces of the guide member 31.

The supporting member 32 reinforces the guide member 31 so that bending deformation of the guide member 31 can be minimized. The supporting member 32 is formed in a channel shape of which a cross-section is substantially U-shape with a flat bottom. The supporting member 32 is disposed inside the guide member 31. The supporting member 32 may be formed in a structure having a large sectional moment of inertia, such as an I-beam, an H-beam, etc., in addition to a U-shape with a flat bottom.

The heat blocking member 34 prevents heat generated in the heat source 60 from directly radiating to the guide member 31. For this purpose, the heat blocking member 34 is disposed over the guide member 31 and supporting member 32 to cover the guide member 31 and supporting member 32. Specifically, the heat blocking member 34 is provided below the heat source 60 in the upper side of the supporting member 32 inserted in the guide member 31.

As illustrated in FIG. 3, a bottom surface of the nip forming member 30, namely, a bottom surface 31*a* of the guide member 31 is in contact with an inner surface of the fixing belt 20, and a top portion of the fixing roller 10, which is in contact with a portion of the fixing belt 20 supported by the bottom surface 31*a* of the guide member 31, forms the fixing nip N. Accordingly, when the fixing roller 10 rotates, the fixing belt 20 is rotated by fiction between the fixing roller 10 and the fixing belt 20. At this time, the nip forming member 30 is disposed inside the fixing belt 20 so that a center of the fixing nip N is formed downstream in an entry direction of the print medium P (an arrow A) than a rotation center O1 of each of the sliding members 40. In other words, as illustrated in FIG. 3, if the nip forming member 30 is disposed inside the fixing belt 20 so that a center line CL of the nip forming member 30 is placed at the downstream of the moving direction of the print medium P (an arrow A) than the rotation center O1 of each of the sliding members 40, the fixing nip N is placed upstream in the moving direction of the print medium P (an arrow A) than the rotation center O1 of each of the sliding members 40. If the fixing belt 20 is supported by disposing the nip forming member 30 inside the fixing belt 20 and the fixing roller 10 and the sliding members 40 are disposed so that the rotation center O2 of the fixing roller 10 and the rotation center O1 of the sliding member 40 are spaced apart a certain distance, fatigue crack that occurs near opposite ends of the fixing belt 20 due to the pressing force of the fixing roller 10 in the fixing apparatus 1 may be minimized.

The pair of sliding members 40 is disposed in the opposite ends of the fixing belt 20, supports the inner surfaces of the opposite ends of the fixing belt 20, and restricts movement of the fixing belt 20 in a central axis direction of the fixing belt 20. The pair of sliding members 40 is disposed in order to minimize the occurrence of the fatigue crack at the opposite ends of the fixing belt 20 when the fixing belt 20 is rotated by the fixing roller 10. Due to the pair of sliding members 40 and the arrangement of the nip forming member 30 as described above, the fixing belt 20 forms a profile as illustrated in FIG. 3. The detailed structure of the pair of sliding members 40 will be described later.

The pair of flange members 50 rotatably supports the pair of sliding members 40. Accordingly, when the fixing belt 20 is rotated by the friction force against the fixing roller 10, the fixing belt 20 rotates through the pair of sliding members 40 disposed between the fixing belt 20 and the flange members 50 without direct friction against the flange members 50.

Referring to FIG. 4, the flange member 50 includes a stationary body 52 and a sliding support portion 51. The stationary body 52 may be formed to be secured to a frame of the fixing apparatus 1 or a frame 90 inside a main body 101. The stationary body 52 is formed in a substantially rectangular parallelepiped shape. A front surface of the stationary body 52 is provided with the sliding support portion 51, and each of opposite side surfaces of the stationary body 52 is provided with a securing groove 52*a* in which the frame 90 (see FIGS. 1 and 2) may be inserted. In the present embodiment, for example, the stationary body 52 is secured to the frame 90 by the securing groove 52*a*; however, a method for securing the stationary body 52 to the frame 90 is not limited thereto. The stationary body 52 may be fixed to the frame 90 in various ways, such as screw fastening.

The sliding support portion 51 may be formed to be eccentric to the center of the stationary body 52. A through hole 54 into which the heat source 60 is inserted is formed below the sliding support portion 51. Two securing holes 55 in which the nip forming member 30 is disposed are provided below the through hole 54. As illustrated in FIG. 2, the opposite ends of the nip forming member 30, in detail, the opposite ends of the guide member 31 are provided with two securing bars 33 that are inserted in the two securing holes 55 of the flange members 50.

The sliding support portion 51 extends vertically from the front surface of the stationary body 52, and rotatably supports the sliding members 40. The sliding support portion 51 may be formed in various shapes as long as it can support rotation of the sliding member 40 and load being applied to the sliding member 40 during the rotation of the fixing belt 20. FIG. 4 illustrates the sliding support portion 51 formed in a semicircular shape by a thin plate in order to make room below the sliding support portion 51. Accordingly, a space in which the heat source 60 is disposed is provided below the sliding support portion 51. At this time, the sliding support portion 51 may be formed to have an arc shape larger or smaller than a semicircle. In the present embodiment, the sliding support portion 51 is formed in a substantially semicircular shape.

Also, the flange member 50 may be provided with a friction reducing portion 70 that reduces friction between the sliding member 40 and the flange member 50 during rotation of the sliding member 50 to improve the service life of the fixing belt 20. The friction reducing portion 70 of the flange member 50 will be described in detail below.

The flange member 50 may be formed of a highly heat-resistant material. For example, the flange member 50 may be formed of poly phenylene sulfide (PPS), etc.

The sliding support portion 51 is formed to minimize the friction against the sliding member 40. For example, a plurality of protrusions 51*a* may be formed on an outer surface of the sliding support portion 51 so that the outer surface of the sliding support portion 51 is not entirely in contact with an inner surface of the sliding member 40 so as to cause the surface friction to be generated. In this embodiment, as illustrated in FIG. 4, three protrusions 51*a* are formed on the outer surface of the sliding support portion 51 facing the inner surface of the sliding members 40. Referring to FIG. 3, one protrusion 51*a* is formed at each of the both ends of the sliding support portion 51, and one protrusion 51*a* is formed at a substantially central portion of the sliding support portion 51. The plurality of protrusions 51*a* is formed parallel to the axial direction of the sliding member 40. The plurality of protrusions 51*a* is formed to be in line contact with the inner surface of the sliding member 40. For example, each of the plurality of protrusions 51*a* may be formed in a pillar shape having a cross-section of a semicircular or arc shape.

Although not illustrated, as another example, a plurality of protrusions for point contact may be formed on the outer surface of the sliding support portion 51 to support the sliding member 40. Alternatively, as another example, although not illustrated, the sliding support portion 51 may be formed in a polygonal shape rather than a semicircular shape. For example, the sliding support portion 51 may be formed so that a strip-like member is bent in a triangular shape, a pentagonal shape, or a hexagonal shape and each vertex thereof supports the sliding member 40.

The heat source 60 is disposed inside the fixing belt 20, and generates heat, thereby heating the fixing belt 20 to a fixing temperature. As illustrated in FIG. 3, the heat source 60 is disposed above the nip forming member 30 between the pair of flange members 50. The heat source 60 may be inserted into the fixing belt 20 through the through hole 54 provided in the flange members 50. The heat source 60 may use a halogen lamp, a ceramic heater, etc. The heat source 60 is connected to an electric wire for supplying the electric power. However, the electric wire is omitted in FIG. 2 for the convenience of illustration. The heat source 60 may use the same as the heat sources used in conventional fixing apparatuses; therefore, a detailed description thereof is omitted.

In the above description, a structure in which the heat source 60 is disposed above the nip forming member 30 and heats the fixing belt 20 by radiation has been explained. However, the heat source 60 may be formed to directly heat the fixing belt 20. In other words, a ceramic heater as the heat source 60 may be disposed on the bottom surface 31*a* of the guide member 31 near the fixing nip N so that the ceramic heater directly heats the inner surface of the fixing belt 20. As another example of the heat source 60, a planar heater (not illustrated) may be used. The planar heater is an electrical resistor that generates heat when current is supplied thereto, and may be formed in a layer sandwiched between the outer surface and the inner surface of the fixing belt 20.

Hereinafter, the sliding member 40 used in the belt type fixing apparatus 1 according to an embodiment of the present disclosure will be described in detail with reference to FIGS. 5 through 9.

FIG. 5 is a perspective view illustrating a sliding member of the belt type fixing apparatus of FIG. 1. FIG. 6 is a perspective view illustrating a flange member in which a sliding member of the belt type fixing apparatus of FIG. 1 is disposed. FIG. 7 is a partial cross-sectional view illustrating the belt type fixing apparatus of FIG. 1 taken along a line 7-7. FIG. 8 is a view illustrating a relationship between a fixing belt and a sliding member when skew of a fixing belt occurs in a belt type fixing apparatus according to an embodiment of the present disclosure, and FIGS. 9A, 9B and 9C are cross-sectional views illustrating shapes of an entry portion of a sliding member which is used in a belt type fixing apparatus according to an embodiment of the present disclosure.

As illustrated in FIG. 5, the sliding member 40 includes an inner surface supporting portion 41 to support the inner surface of the fixing belt 20 and a flange 42 which extends vertically from the inner surface supporting portion 41 and prevents movement of the fixing belt 20 in the central axis direction of the fixing belt 20. The inner surface supporting portion 41 of the sliding member 40 is formed in a ring shape, and the flange 42 is formed to extend by a predetermined length from an end of the inner surface supporting portion 41 in a direction perpendicular to the outer surface of the inner surface supporting portion 41. Accordingly, the flange 42 forms a substantially donut shape. An inner diameter of the inner surface supporting portion 41 of the sliding member 40 may be determined to be a size that can be inserted on the outside of the sliding support portion 51 of the flange member 50. Accordingly, as illustrated in FIGS. 6 and 7, when the sliding member 40 is inserted in the sliding support portion 51 of the flange member 50, the sliding member 40 can rotate about the sliding support portion 51. In a state in which the sliding member 40 is inserted into the sliding support portion 51 of the flange member 50, when the fixing belt 20 rotates, the sliding member 40 is rotated about the flange member 50. At this time, the sliding member 40 is rotated on the center of the sliding support portion 51 of the flange member 50 as the rotation center O1. Accordingly, as illustrated in FIG. 3, the rotation center O1 of the sliding member 40 is located upstream in the entry direction (arrow A) of the print medium P by a predetermined distance d than the rotation center O2 of the fixing roller 10. Also, in order to reduce friction between the sliding member 40 and the sliding support portion 51 of the flange member 50, the sliding member 40 may be formed of low friction materials. For example, the sliding member 40 may be formed of polytetrafluoroethylene (PTFE), perfluorinated acids (PFA), polyetheretherketone (PEEK), liquid crystal polymer (LCP), polyphenylene sulfine (PPS), etc.

A width W of the flange 42 extending from the inner surface supporting portion 41 of the sliding member 40 is formed larger than the thickness of the fixing belt 20 so that the fixing belt 20 rotating along with the sliding member 40 does not clime over the flange 42. For example, if the thickness of the fixing belt 20 is 0.3 mm, the width W of the flange 42 may be formed to be 2.5~3 mm.

Also, as illustrated in FIGS. 5 and 7, the flange 42 of the sliding member 40 may include an entry surface 44 which is inclined to a surface 41*b* perpendicular to the inner surface supporting portion 41. The entry surface 44 formed in the flange 42 may minimize or remove noise by mitigating the impact that occurs between the flange 42 and the fixing belt 20 during rotation of the fixing belt 20. When the fixing belt 20 rotates, the fixing belt 20 rotates along with the sliding member 40 while drawing a profile as illustrated in FIG. 8. At this time, since a circumferential length of the inner surface of the fixing belt 20 is longer than a circumferential length of the outer surface 41*a* of the inner surface supporting portion 41 of the sliding member 40, a portion of the fixing belt 20 which passed through the fixing nip N is spaced apart from the outer surface 41*a* of the inner surface supporting portion 41 of the sliding member 40, and then again becomes in contact with the outer surface 41*a* of the inner surface supporting portion 41 as illustrated in FIG. 8.

At this time, in a point (a C portion of FIG. 8) where a separated portion of the fixing belt 20 again approaches to the inner surface supporting portion 41 of the sliding member 40, the one end of the fixing belt 20 clashes with the end of the flange 42 due to the skew of the fixing belt 20, thereby generating noise. Accordingly, if an inclined entry surface 44 is provided in the end of the flange 42 of the sliding member 40, the portion of the fixing belt 20 approaching to the inner surface supporting portion 41 of the sliding member 40 is guided by the entry surface 44 and smoothly becomes in contact with the outer surface 41*a* of the inner surface supporting portion 41 so that noise may be suppressed.

In order to prevent noise generated by the contact impact of the fixing belt 20 and the flange 42 of the sliding member 40, an angle of entry surface 44 may be determined in an angle range between 15 degrees and 75 degrees. In detail, as illustrated in FIGS. 9A, 9B and 9C, an angle θ of the entry surface 44 with respect to the surface 41*b* perpendicular to the outer surface 41*a* of the inner surface supporting portion 41 of the sliding member 40 is formed to be an angle between 15 degrees and 75 degrees. Also, the entry surface 44 may be formed to start from a position flange 42 which is at least two times higher than the thickness of the fixing belt 20. For example, if the thickness of the fixing belt 20 is 0.3 mm, the start height of the entry surface 44 may be determined as 0.7 mm.

The entry surface 44 of the sliding member 40 may be formed in a plane as illustrated in FIG. 9A. Alternatively, as illustrated in FIGS. 9B and 9C, the entry surface 44 of the sliding member 40 may be formed in a curved surface. If the entry surface 44 is formed in a curved surface, an angle θ between a straight line 45 connecting a start point 44*a* and an end point 44*b* of the curved surface forming the entry surface 44 and the surface 41*b* perpendicular to the inner surface supporting portion 41 of the sliding member 40 may be formed to be an angle between 15 degrees and 75 degrees. At this time, as illustrated in FIG. 99B, the entry surface 44 may be formed in a curved surface that is convex upwardly from the straight line 45 connecting the start point 44*a* and the end point 44*b* of the curved surface. Alternatively, as illustrated in FIG. 9C, the entry surface 44 may be formed in a curved surface that is concave downwardly from the straight line 45 connecting the start point 44*a* and the end point 44*b* of the curved surface.

On the other hand, when the fixing belt 20 is rotated by the fixing roller 10, the rotation of the fixing belt 20 is supported by the sliding support portion 51 of the flange member 50. In detail, when the fixing roller 10 rotates, the pair of sliding members 40 supporting the inner surfaces of the opposite ends of the fixing belt 20 is rotated with the fixing belt 20 due to the rotation of the fixing belt 20. Accordingly, if the fixing belt 20 is rotated, the sliding member 40 is rotated against the flange member 50. At this time, the fixing belt 20 may be relatively moved against the sliding member 40 or rotated along with the sliding member 40 without relative movement against the sliding member 40.

Hereinafter, a speed of the sliding member 40 which is rotated against the flange member 50 by the fixing belt 20 is referred to as a first speed, and a speed of the fixing belt 20 which rotates against the sliding member 40, namely, a relative speed between the fixing belt 20 and the sliding member 40 is referred to as a second speed.

In order to suppress the fatigue crack at the opposite ends of the fixing belt 20, the fixing belt 20 may be rotated as one body with the pair of sliding members 40 so that relative movement does not occur between the fixing belt 20 and the sliding member 40. If the sliding member 40 rotates integrally with the fixing belt 20, the first speed is the speed of the fixing belt 20, and the second speed is zero (0). However, if the inner diameter of the fixing belt 20 is larger than the diameter of the outer surface 41*a* of the inner surface supporting portion 41 of the sliding member 40 as the embodiment of the present disclosure, relative movement may occur between the sliding member 40 and the fixing belt 20. At this time, in order to suppress the fatigue crack of the opposite ends of the fixing belt 20, a relative speed between the fixing belt 20 and the sliding member 40 may be smaller than the speed of the sliding member 40 which rotates against the flange member 50. In other words, the second speed may be smaller than the first speed.

For this purpose, a friction force between the outer surface of the sliding support portion 51 of the flange member 50 and the inner surface of the inner surface supporting portion 41 of the sliding member 40 may be smaller than a friction force between the outer surface 41*a* of the inner surface supporting portion 41 of the sliding member 40 and the inner surface of the fixing belt 20. By this configuration, when the fixing belt 20 rotates, the fixing belt 20 may rotate with the sliding member 40 without slipping against the sliding member 40 and the sliding member 40 may rotate against the sliding support portion 51 of the flange member 50 due to the friction force between the fixing belt 20 and the outer surface 41*a* of the inner surface supporting portion 41 of the sliding member 40. If the friction reducing portion 70 is formed on the outer surface of the sliding support portion 51 of the flange member 50 as described below, the friction force between the outer surface of the sliding support portion 51 and the inner surface of the inner surface supporting portion 41 of the sliding member 40 may be made smaller than the friction force between the fixing belt 20 and the outer surface of the inner surface supporting portion 41 of the sliding member 40.

Hereinafter, the friction reducing portion 70 of the flange member 50 used in the belt type fixing apparatus 1 according to an embodiment of the present disclosure will be described in detail with reference to FIGS. 4, 6, and 10 to 17.

FIG. 10 is a front view illustrating a flange member in which the sliding member of FIG. 6 is disposed, and FIG. 11 is a side view illustrating a flange member in which the sliding member of FIG. 6 is disposed. FIG. 12 is a front view illustrating a flange member provided with a friction reducing portion according to another example. FIG. 13A is a partial perspective view illustrating a case in which a first projection of a friction reducing portion of a flange member is a triangular prism shape, and FIG. 13B is a partial perspective view illustrating a case in which a first projection of a friction reducing portion of a flange member is a pentagonal prism shape. FIG. 14 is a perspective view illustrating a flange member provided with a first projection of a friction reducing portion that is a spherical. FIG. 15 is a front view illustrating a state in which a flange member provided with a friction reducing portion according to another example supports a sliding member. FIG. 16 is a perspective view illustrating a flange member provided with a friction reducing portion according to another example, and FIG. 17 is a front view illustrating the flange member of FIG. 16 in which a sliding member is disposed.

As illustrated in FIG. 4, the flange member 50 according to an embodiment of the present disclosure is provided with the friction reducing portion 70. The friction reducing portion 70 may include a plurality of first projections 71 that is formed on the sliding support portion 51 and a plurality of second projections 72 that is formed on the stationary body 52.

The plurality of first projections 71 is formed to minimize friction between the inner surface of the inner surface supporting portion 41 of the sliding member 40 and the outer surface of the sliding support portion 51 of the flange member 50. The plurality of first projections 71 may be formed to prevent the inner surface of the inner surface supporting portion 41 of the sliding member 40 from causing surface friction by contacting as a whole with the outer surface of the sliding support portion 51. In detail, the plurality of first projections 71 may be formed to prevent the inner surface supporting portion 41 of the sliding member 40 from being in surface contact with the outer surface of the sliding support portion 51, and to allow the outer surface of the sliding support portion 51 support the sliding member 40 by being in line contact or point contact with the inner surface of the inner surface supporting portion 41 of the sliding member 40.

For example, as illustrated in FIG. 4, the outer surface of the sliding support portion 51 that faces the inner surface of the inner surface supporting portion 41 of the sliding member 40 may be provided with three first projections 71. Referring to FIG. 4, two of first projections 71 are formed on opposite ends of the sliding support portion 51, and one of the first projections 71 is formed substantially at the center of the sliding support portion 51. The plurality of first projections 71 is formed in parallel to the axial direction of the sliding member 40, and, as illustrated in FIG. 11, is formed to be in line contact with the inner surface of the inner surface supporting portion 41 of the sliding member 40. The first projections 71 as illustrated in FIG. 4 are formed in a pillar shape having a cross-section of semicircle or arc-shape. Also, in an embodiment as illustrated in FIGS. 4, 6, and 10, three first projections 71 are formed on the outer surface of the sliding support portion 51; however, the number of the first projections 71 is not limited thereto. The number of the first projections 71 may be three or more. In other words, in order to stably support the rotation of the inner surface supporting portion 41 of the sliding member 40, at least three first projections 71 may be provided on the outer surface of the sliding support portion 51 of the flange member 50. FIG. 12 illustrates a case in which four first projections 71 are provided on the sliding support portion 51.

As another example, the plurality of first projections 71 may be formed not in a pillar having a cross-section of an arc shape but in a polygonal pillar. For example, as illustrated in FIG. 13A, the first projection 71 may be formed in a triangular prism. Alternatively, as illustrated in FIG. 13B, the first projection 71 may be formed in a pentagonal pillar. At this time, an edge of the polygonal pillar may be formed to support the inner surface of the inner surface supporting portion 41 of the sliding member 40 so that first projections 71 are in line contact with and support the inner surface of the inner surface supporting portion 41 of the sliding member 40.

As another example, as illustrated in FIG. 14, the plurality of first projections 71 may be formed in a spherical surface. In this case, the plurality of first projections 71 formed on the outer surface of the sliding support portion 51 support the inner surface of the inner surface supporting portion 41 of the sliding member 40 by being in point contact with the inner surface of the inner surface supporting portion 41 of the sliding member 40.

Further, as another example, without the plurality of first projections 71, the sliding support portion 51 may be formed not in a semicircular shape but in a polygonal shape so that the sliding support portion 51 itself is in line contact with and supports the inner surface supporting portion 41 of the sliding member 40. For example, the sliding support portion 51' may be formed in a triangular, quadrangular, pentagonal shape or the like by bending a strip-shaped member, and each edge of the sliding support portion 51' may be formed to support the inner surface of the inner surface supporting portion 41 of the sliding member 40. FIG. 15 illustrates a case in which the sliding support portion 51' is bent in a pentagonal shape and supports the inner surface supporting portion 41 of the sliding member 40.

The plurality of second projections 72 is formed to reduce friction that is generated between the flange 42 of the sliding member 40 and a side surface of the stationary body 52 of the flange member 50 during rotation of the sliding member 40. The plurality of second projections 72 may be formed to prevent the flange 42 of the sliding member 40 from being in surface friction with the stationary body 52 of the flange member 50 as a whole. In detail, the plurality of second projections 72 may be formed on the stationary body 52 to support the flange 42 of the sliding member 40 by being in line contact or point contact with the flange 42. At this time, at least three second projections 72 may be provided on one surface of the stationary body 52 of the flange member 50 to stably support the flange 42 of the sliding member 40. For example, as illustrated in FIGS. 4 and 10, four second projections 72 may be provided on the surface of the stationary body 52 of the flange member 50 from which the sliding support portion 51 projects. As another example, as illustrated in FIG. 12, six second projections 72 may be provided on the stationary body 52 of the flange member 50.

The second projections 72 may be formed in a spherical surface as illustrated in FIG. 4. At this time, the second projections 72 are in point contact with the flange 42 of the sliding member 40. As another example, in order to stably support the flange 42 of the sliding member 40, a circular groove having a predetermined diameter may be formed at the front end of each of the second projections 72 that is in contact with the flange 42 of the sliding member 40. In FIG. 14, the reference numeral 72*a* represents a contact portion of the second projection 72 which is formed in a circular groove and is in contact with the flange 42 of the sliding member 40.

In FIG. 4, for example, the second projections 72 are formed in a spherical surface; however, the shape of the second projection 72 is not limited thereto. As long as the second projections 72 can stably support the flange 42 of the sliding member 40, the second projections 72 may be formed in a variety of shapes. For example, the second projections 72 may be formed in a cone, polygonal pyramid, truncated cone, truncated polygonal pyramid, etc. In this case, the second projections 72 may be in point contact with and support the flange 42 of the sliding member 40.

As another example, the second projections 72, as illustrated in FIG. 16, may be formed in a pillar shape having a semicircular or arc cross-section. In this case, the second projections 72, as illustrated in FIG. 17, support the sliding member 40 while being in line contact with the flange 42 of the sliding member 40. Accordingly, the plurality of second projections 72 may stably support the flange 42 of the sliding member 40, and minimize the friction of the sliding member 40 against the stationary body 52 of the flange member 50 during the rotation of the sliding member 40.

As another example, as not illustrated, the second projections 72 may be formed not in a pillar having a cross-section of an arc shape but in a polygonal pillar. For example, the second projections 72 may be formed in a triangular pillar, pentagonal pillar, hexagonal pillar, and the like. In the case of a triangular pillar, the second projections 72 may be formed similarly to the first projection 71 as illustrated in FIG. 13A. In the case of a pentagonal pillar, the second projections 72 may be formed similarly to the first projection 71 as illustrated in FIG. 13B. At this time, an edge of the polygonal pillar may be formed to support the flange 42 of the sliding member 40 so that the second projections 72 are in line contact with and support the flange 42 of the sliding member 40.

In the above description, the friction reducing portion 70 provided in the flange member 50 includes the plurality of first projections 71 formed on the sliding support portion 51 and the plurality of second projections 72 formed on the stationary body 52. However, the friction reducing portion 70 provided in the flange member 50 does not need to be provided with both the first projections 71 and the second projections 72.

For example, the friction reducing portion 70 of the flange member 50 may include only the plurality of first projections 71 formed in the sliding support portion 51, and the plurality of second projections 72 may not be formed in the stationary body 52. As another example, the friction reducing portion 70 of the flange member 50 may include only the plurality of second projections 72 formed in the stationary body 52, and the plurality of first projections 71 may not be formed in the sliding support portion 51.

Hereinafter, an operation of the belt type fixing apparatus 1 according to an embodiment of the present disclosure having the structure as described above will be described with reference to FIGS. 1 and 3.

When the fixing roller 10 rotates, the fixing belt 20 in contact with the fixing roller 10 is rotated by a friction force between the fixing roller 10 and the fixing belt 20. At this time, the opposite ends of the fixing belt 20 are supported by a pair of sliding members 40. Also, each of the pair of sliding members 40 is inserted in sliding support portion 51 of each of a pair of flange members 50. Accordingly, if the fixing belt 20 receives the friction force by the rotating fixing roller 10, the fixing belt 20 is rotated with the pair of sliding members 40 in a state in which the fixing belt 20 is supported by the sliding support portions 51 of the pair of flange members 50. At this time, since the friction force between the inner surface of the fixing belt 20 and the outer surface 41*a* of the inner surface supporting portion 41 of the sliding member 40 is larger than the friction force between the outer surface of the sliding support portion 51 of the flange member 50 and the inner surface of the inner surface supporting portion 41 of the sliding member 40, the fixing belt 20 is rotated along with the sliding member 40. In the case of the present disclosure, since the flange member 50 is provided with the friction reducing portion 70, the frictional force between the outer surface of the sliding support portion 51 of the flange member 50 and the inner surface of the inner surface supporting portion 41 of the sliding member 40 is very small.

Even if the fixing belt 20 and the sliding member 40 do not rotate with the same speed, and the fixing belt 20 relatively moves against the sliding member 40, a relative speed of the fixing belt 20 against the sliding member 40 is slower than a speed of the sliding member 40 which rotates against the sliding support portion 51 of the flange member 50. As a result, the fatigue crack that is caused by the rotation of the fixing belt 20 against the flange member 50 may be reduced. An inventor tested the printing life to confirm the extended life of the belt type fixing apparatus 1 according to an embodiment of the present disclosure. As a result, a conventional fixing apparatus was able to print up to 272,047 sheets, but the belt type fixing apparatus 1 according to an embodiment of the present disclosure was able to print up to 1,241,775 sheets. Accordingly, if the belt type fixing apparatus 1 according to an embodiment of the present disclosure is used, it can be seen that the lifespan of the fixing apparatus 1 extends about four times or more. However, if flange member 50 is not provided with the friction reducing portion 70, the belt type fixing apparatus 1 according to an embodiment of the present disclosure may print approximately 600,000 sheets.

Further, with the belt type fixing apparatus 1 according to an embodiment of the present disclosure, since the inclined surface 44 is provided in the flange 42 of the sliding member 40, during rotation of the fixing belt 20, when a portion of the fixing belt 20 that was spaced apart from the inner surface supporting portion 41 of the sliding member 40 along the bottom surface 31*a* of the nip forming member 30 again enters the inner surface supporting portion 41 of the sliding member 40, noise generated by crash between the fixing belt 20 and the sliding member 40 may be reduced or removed.

In the above description, a case in which the sliding member 40 is formed in a single body, namely, the inner surface supporting portion 41 and the flange 42 configuring the sliding member 40 are formed in a single body has been described. However, the sliding member 40 may be formed in a split type sliding member of which an inner surface supporting portion 41 and a flange 42 are formed in separate parts.

Hereinafter, the split type sliding member 40' will be explained in detail with reference to FIGS. 18 and 19.

FIG. 18 is a perspective view illustrating another example of a sliding member which is used in a belt type fixing apparatus according to an embodiment of the present disclosure, and FIG. 19 is a partial cross-sectional view illustrating a relationship between a flange member, a sliding member, and a fixing belt when a split type sliding member as illustrated in FIG. 18 is used.

Referring to FIGS. 18 and 19, the split type sliding member 40' includes an inner surface supporting portion 41' and a flange 42'. The inner surface supporting portion 41' is formed in a ring shape, and is inserted in a sliding support portion 51' of a flange member 50' so as to support rotation of the fixing belt 20. The flange 42' is formed in a donut-shaped thin plate, and is inserted in the sliding support portion 51' of the flange member 50' so as to prevent the fixing belt 20 form moving in a central axis direction of the fixing belt 20. The sliding support portion 51' of the flange member 50' may include at least one slip-off preventing member 53 to prevent the inner surface supporting portion 41' and flange 42' from slipping off the sliding support portion 51'. In a case of this embodiment, as illustrated in FIG. 19, a plurality of hooks is formed at an end of the sliding support portion 51' as the slip-off preventing member 53. At this time, the plurality of hooks 53 may be formed of an elastic material. Accordingly, the flange 42' and the inner surface supporting portion 41' may be inserted in or removed from the sliding support portion 51' of the flange member 50'.

The other configurations of the inner surface supporting portion 41' and flange 42' of the split type sliding member 40' are the same as or similar to the inner surface supporting portion 41 and the flange 42 of the integrated type sliding member 40. Therefore, detailed descriptions thereof are omitted.

Also, the flange member 50' for supporting the split type sliding member 40' is the same as or similar to the flange member 50 for supporting the integrated type sliding member 40 as described above except that the slip-off preventing member 53 is provided at one end of the sliding support portion 51'. Therefore, detailed description thereof is omitted.

Hereinafter, an image forming apparatus 100 having the belt type fixing apparatus 1 according to an embodiment of the present disclosure will be explained with reference to FIG. 20.

Referring to FIG. 20, the image forming apparatus 100 includes a main body 101, a print medium supplying unit 110, an image forming unit 120, the belt type fixing apparatus 1, and a discharging unit 150.

The main body 101 forms an external appearance of the image forming apparatus 100, and accommodates and supports the print medium supplying unit 110, the image forming unit 120, the belt type fixing apparatus 1, and the discharging unit 150 inside the main body 101.

The print medium supplying unit 110 is disposed inside the main body 101, supplies print media P to the image forming unit 120, and includes a paper feeding cassette 111 and a pickup roller 112. The paper feeding cassette 111 stores a certain sheets of print media, and the pickup roller 112 picks up the print media stored in the paper feeding cassette 111 one by one and supplies the picked print medium P to the image forming unit 120.

A plurality of conveying rollers 115 to convey the picked print medium P is disposed between the pickup roller 112 and the image forming unit 120.

The image forming unit 120 forms a certain image on the print medium P supplied from the print medium supplying unit 110, and may include an exposure unit 121, a developing cartridge 130, and a transfer roller 140. The exposure unit 121 emits light corresponding to print data depending on a printing command. The developing cartridge 130 may include an image carrier 131 on which an electrostatic latent image is formed by light generated from the exposure unit 121 and a developing roller 132 which is disposed in a side of the image carrier 131 and supplies developer to the image carrier 131 so as to develop the electrostatic latent image formed on the image carrier 131 into a developer image. In addition, the developing cartridge 130 may store a predetermined amount of developer, and include a developer supplying roller 133 for supplying developer to the developing roller 132, an agitator 134 for agitating the developer, a cleaning blade 135 for cleaning a surface of the image carrier 131, etc. The transfer roller 140 is rotatably disposed to face the image carrier 131 of the developing cartridge 130, and allows the developer image formed on the image carrier 131 to be transferred onto the print medium P.

The belt type fixing apparatus 1 applies heat and pressure to the print medium P while the print medium P onto which the developer image is transferred in the image forming unit 120 is passing through the belt type fixing apparatus 1, thereby fixing the developer image onto the print medium P. The structure and operation of the belt type fixing apparatus 1 are described above in detail; therefore, a detailed description thereof is omitted.

The discharging unit 150 discharges the print medium P on which the image is fixed by the belt type fixing apparatus 1 outside the image forming apparatus 100, and may be formed as a pair of discharging rollers to rotate while facing each other.

The belt type fixing apparatus 1 according to an embodiment of the present disclosure allows the transferred developer image to be fixed onto the print medium P. Also, in the belt type fixing apparatus 1 according to an embodiment of the present disclosure, the opposite ends of the fixing belt 20 are supported by the pair of sliding members 40 so that fatigue crack of the opposite ends of the fixing belt 20, which occurs when the fixing belt 20 rotates in direct contact with the flange member 50, may be minimized.

What is claimed is:

1. A belt type fixing apparatus comprising:

a fixing roller;

a fixing belt disposed to face the fixing roller of the belt type fixing apparatus;

a nip forming member disposed inside the fixing belt, the nip forming member supporting the fixing belt so that the fixing belt is in contact with the fixing roller to form a fixing nip;

a pair of sliding members rotatably disposed at opposite ends of the fixing belt, respectively, a sliding member of the pair of sliding members having at least a portion of the sliding member disposed inside the fixing belt, in an axial direction of the fixing belt and a radial direction of the fixing belt, and at least a portion of the sliding member disposed outside the fixing belt in the axial direction of the fixing belt, and the pair of sliding members configured to directly support and rotate with an inner surface of each of the opposite ends of the fixing belt; and a pair of flange members configured to rotatably support the pair of sliding members, respectively.

2. The belt type fixing apparatus of claim 1, wherein, when the fixing belt is rotated by the fixing roller, a first relative speed between the sliding member and a respective flange member of the pair of flange members is larger than a second relative speed between the fixing belt and the sliding member.

3. The belt type fixing apparatus of claim 1, wherein the sliding member comprises, an inner surface supporting portion supporting the inner surface of each of the opposite ends of the fixing belt; and a flange formed in a direction perpendicular to the inner surface supporting portion, the flange configured to restrict movement of the fixing belt in a central axis direction of the fixing belt.

4. The belt type fixing apparatus of claim 3, wherein the inner surface supporting portion and the flange of the sliding member are formed as separate parts or a single body.

5. The belt type fixing apparatus of claim 3, wherein the flange of the sliding member includes an entry surface that is inclined to a surface perpendicular to the inner surface supporting portion.

6. The belt type fixing apparatus of claim 5, wherein the entry surface comprises a plane that is inclined an angle between 15 degrees and 75 degrees with respect to the surface perpendicular to the inner surface supporting portion of the sliding member.

7. The belt type fixing apparatus of claim 5, wherein the entry surface is formed as an curved surface, and a straight line connecting a start point and an end point of the curved surface forms an angle between 15 degrees and 75 degrees with respect to the surface perpendicular to the inner surface supporting portion of the sliding member.

8. The belt type fixing apparatus of claim 7, wherein the entry surface comprises a convex curved surface or a concave curved surface.

9. The belt type fixing apparatus of claim 1, wherein a rotation center of each of the pair of sliding members is located upstream in a moving direction of a print medium than a rotation center of the fixing roller.

10. The belt type fixing apparatus of claim 1, wherein a rotation center of each of the pair of sliding members is located upstream in a moving direction of a print medium than a center line of the nip forming member.

11. The belt type fixing apparatus of claim 1, wherein the flange member comprises, a stationary body; and a sliding support portion extending from the stationary body and configured to rotatably support the sliding member.

12. The belt type fixing apparatus of claim 11, wherein the flange member further comprises a friction reducing portion that can reduce friction against the sliding member.

13. The belt type fixing apparatus of claim 12, wherein the friction reducing portion comprises at least three first projections that are formed on a surface of the sliding support portion facing an inner surface of the sliding member.

14. The belt type fixing apparatus of claim 12, wherein the friction reducing portion comprises at least three second projections that are formed on a surface of the stationary body facing a side surface of the sliding member.

15. The belt type fixing apparatus of claim 12, wherein the friction reducing portion comprises at least three first projections that are formed on an outer surface of the sliding support portion facing an inner surface of the sliding member and at least three second projections that are formed on a surface of the stationary body facing a side surface of the sliding member.

* * * * *